US005934370A

United States Patent [19]

Hoeptner, III

[11] Patent Number: 5,934,370

[45] Date of Patent: Aug. 10, 1999

[54] WELL WATER FLOW DIVERTER APPARATUS

[76] Inventor: Herbert W. Hoeptner, III, 7796 Oak Springs Cir., Gilroy, Calif. 95020

[21] Appl. No.: 08/976,516

[22] Filed: Nov. 24, 1997

[51] Int. Cl.[6] ..... E03B 3/11; E21B 34/14

[52] U.S. Cl. ..... 166/50; 166/68.5; 137/282

[58] Field of Search ..... 166/50, 68.5, 69, 166/72, 100, 117, 373, 381; 137/281, 282, 291, 292

[56] References Cited

U.S. PATENT DOCUMENTS

| | | | |
|---|---|---|---|
| 196,384 | 10/1877 | Porteous . | |
| 1,786,357 | 12/1930 | Miller . | |
| 1,987,883 | 1/1935 | White et al. . | |
| 2,375,865 | 5/1945 | Nebolsine | 166/50 |
| 2,383,496 | 8/1945 | Nebolsine | 166/50 X |
| 2,598,968 | 6/1952 | Boosey . | |
| 2,605,781 | 8/1952 | Schmidt et al. . | |
| 3,017,896 | 1/1962 | Papacek . | |
| 3,770,003 | 11/1973 | Uroshevich . | |
| 3,885,585 | 5/1975 | Carpentier . | |
| 4,109,671 | 8/1978 | Hughes et al. . | |
| 4,434,849 | 3/1984 | Allen | 166/252 |
| 4,653,522 | 3/1987 | Fillman et al. . | |
| 4,854,339 | 8/1989 | Hoeptner, III . | |
| 5,033,500 | 7/1991 | Hoeptner, III . | |
| 5,439,051 | 8/1995 | Kennedy et al. | 166/50 |
| 5,680,901 | 10/1997 | Gardes | 166/313 |
| 5,701,925 | 12/1997 | Mulligan et al. . | |

OTHER PUBLICATIONS

"Merrill SP Pitless Units", Merrill Manufacturing, Storm Lake, IA.

"Campbell M1 Pitless Adapters", Campbell Manufacturing, Inc.

"Campbell M4 Pitless Adapters", Campbell Manufacturing, Inc., Bechtelsville, PA.

*Primary Examiner*—Frank Tsay

*Attorney, Agent, or Firm*—William W. Haefliger

[57] ABSTRACT

For combination with a tubular casing, the casing having a bore and a side wall through port, the improvement comprises, in combination, an assembly to be lowered in the casing to establish water flow upwardly in the casing, and then out the side port, the assembly comprises a hollow body sized to travel in the casing, the body having a side nipple, to be received in the port, the body having a lower connection to which a well pipe is connectible to deliver water upwardly to the nipple; a dog pivotally connected to the body and having first and second legs alternately engageable with the casing bore; and elongated support structure extending within and upwardly from the body and movable longitudinally in the casing and rotatable relative to the body, the structure having operative connection to the dog to pivot the dog between a first position, in which the dog first leg engages the casing bore to thereby retain the nipple within the casing bore spaced from the side port, and a second position in which the dog first leg is retracted away from the casing bore and the dog second leg is engageable with the casing bore to urge the nipple sidewardly toward the port.

14 Claims, 7 Drawing Sheets

67
44
68
12
75
10
10a
11
20
13
50
51
52
14
42
44
43
40
P
41

75
10
90a
90a
50
51
60
64
28
70
70
76
76
42

75
96
98
91c
80
8
8
90
10
98a
50
51
91
60
72

80a
91c
80
90a
90a
80
80a
90
95
98

WELL WATER FLOW DIVERTER APPARATUS

BACKGROUND OF THE INVENTION

This invention relates generally to freeze resistant water supply installations; and more particularly, to installation in a well of apparatus to control water flow sidewardly from the well.

Freezing of water in flow control apparatus in wells, as for example in remote locations, such as farms, ranches, and other locations, etc., is a persistent problem. Attempts to overcome this problem have led to development of apparatus installable in a water supply well, to redirect water flow from an upward direction to a lateral, as for example horizontal, flow direction, below the ground surface.

There is need for improved equipment or apparatus, which can be lowered into the well from the surface and manipulated, to establish the lateral redirection of flow. To this end, there is great need for simple apparatus which can be lowered into a well, as via elongated lift out support structure, and then manipulated solely via the same support structure, to establish the needed side connection to an underground sideward flow-line, for thereby achieving upward water flow diversion in the well to the underground flow line, all without digging up the earth to gain access to the side connection.

SUMMARY OF THE INVENTION

It is a major object of the invention to provide simple, reliable flow control apparatus that meets the above needs, whereby only one elongated support, such as a lift-out rod, need be manipulated to achieve the underground remote connection. Basically, the invention is adapted for use in combination with a tubular casing to be sunk or installed in a well bore, the casing having a side wall through port.

The invention includes an assembly to be lowered in the casing to establish water flow upwardly in the well and casing, then redirected out the side port, and includes, in combination:

a) a hollow body sized to travel in the casing, the body having a side nipple, to be received in the port, the body having a lower connection to which well pipe is connectible to deliver water upwardly to the nipple, b) and means, including dogging means manipulatively engageable with different portions of the well casing to selectively:

i) retain the nipple within the casing bore and out of the side port, as during travel of the hollow body lengthwise in the casing, ii) urge the nipple laterally toward and into the side port, thereby to establish flow communication with a lateral underground flow line.

It is another object to provide a dog pivotally connected to the hollow body and having first and second legs alternately engageable with the well bore in order to accomplish the above-referenced nipple retaining and nipple urging functions, as referred to.

A further object includes provision of an elongated lift out support structure extending within and upwardly from the body and movable longitudinally in the case and rotatable relative to the body, the structure having operative connection to the dog to pivot the dog between a first position in which the dog first leg engages the casing bore to thereby retain the nipple within the casing bore spaced from the side port, and a second position in which the dog first leg is retracted away from the casing bore and the dog second leg is engageable with the casing bore to urge the nipple sidewardly toward the side port Yet another object is to provide operative connection of the support structure to the dog that includes tongue and groove locking elements, one of the elements on the support structure and the other of the elements on the hollow body, one of the elements rotatable relative to the other of the elements in response to rotation of the elongated support structure to interengage the tongue and groove elements, thereby locking the dog in the secondary position.

A further object is to provide a dog pivot axis characterized in that the support structure is connected to the dog in offset relation to the dog pivot axis, to urge the dog clockwise upon upward displacement of the lifting support structure.

An additional object is to provide two modes of attachment of the support structure to the hollow body, the first mode of attachment being in effect when the dog first leg engages the casing bore, and the second mode of attachment being in effect when the dog second leg engages the casing bore. In this regard, the support structure in its first mode of attachment is preferably upwardly displaced relative to the hollow body, and the support structure in its second mode of attachment is downwardly displaced relative to the hollow body and also rotated relative to the hollow body.

A yet further object is to provide a J-slot in a wall of the hollow body, there being a projection on the support structure that is received in the J-slot and movable between upper and lower positions therein corresponding to the first and second modes of attachment, respectively.

These and other objects and advantages of the invention, as well as the details of an illustrative embodiment, will be more fully understood from the following specification and drawings, in which:

DRAWING DESCRIPTION

DETAILED DESCRIPTION

Figure 1:
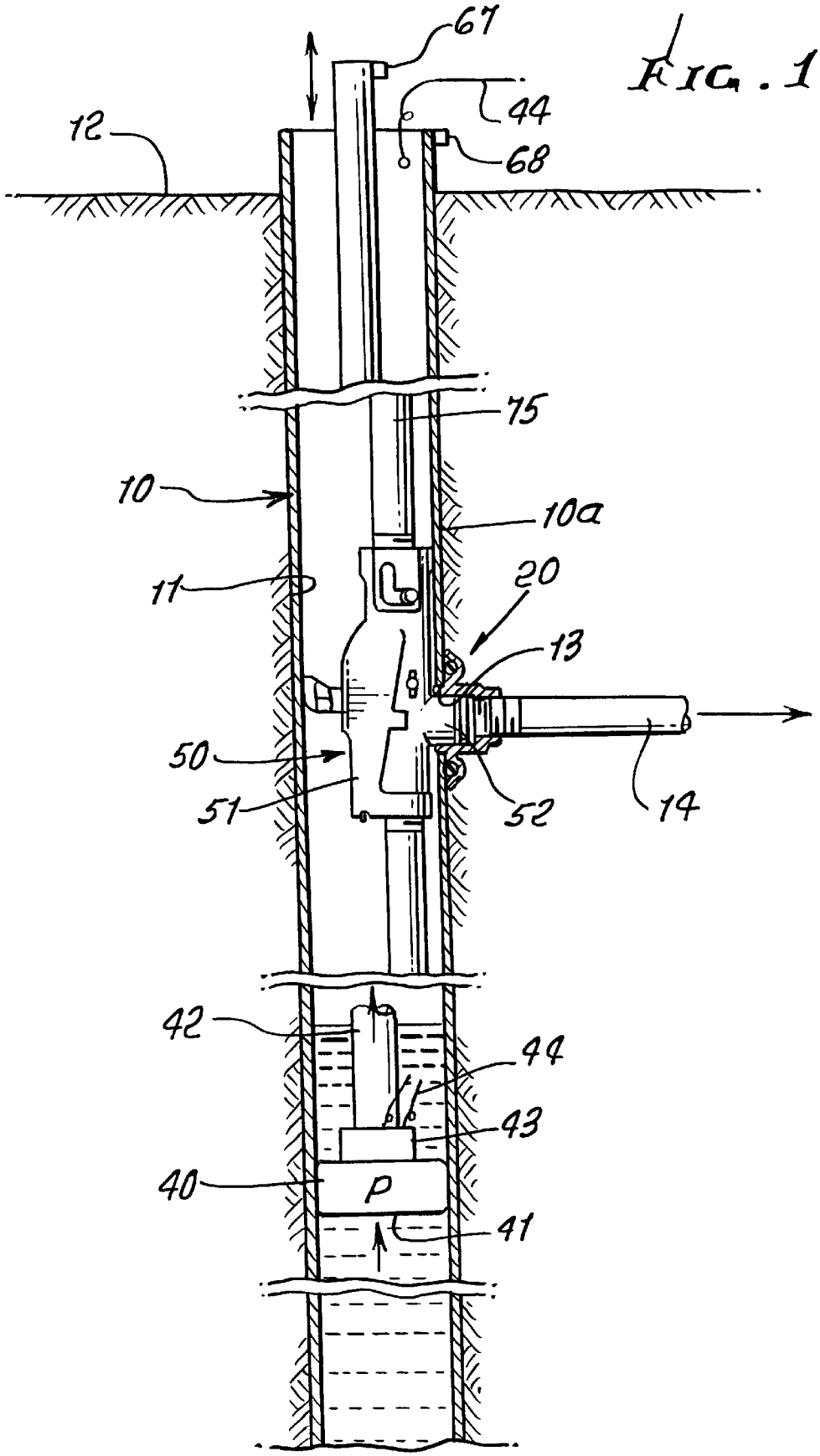
FIG. 1 is an elevation showing a well, well casing, and the flow-diverting apparatus of the invention installed in the well.

Referring first to FIG. 1, a tubular casing 10 is installed in a well bore 11, below the earth surface 12. The casing may, for example, consist of synthetic resinous material; and it has a side wall 10*a*. A side port 13 is formed in the wall, to allow water flow diversion, to flow laterally in or to a lateral sub-surface pipe 14. Port 13 and pipe 14 are sufficiently below the surface 12, so as not to be subject to freezing temperatures.

Figure 2:
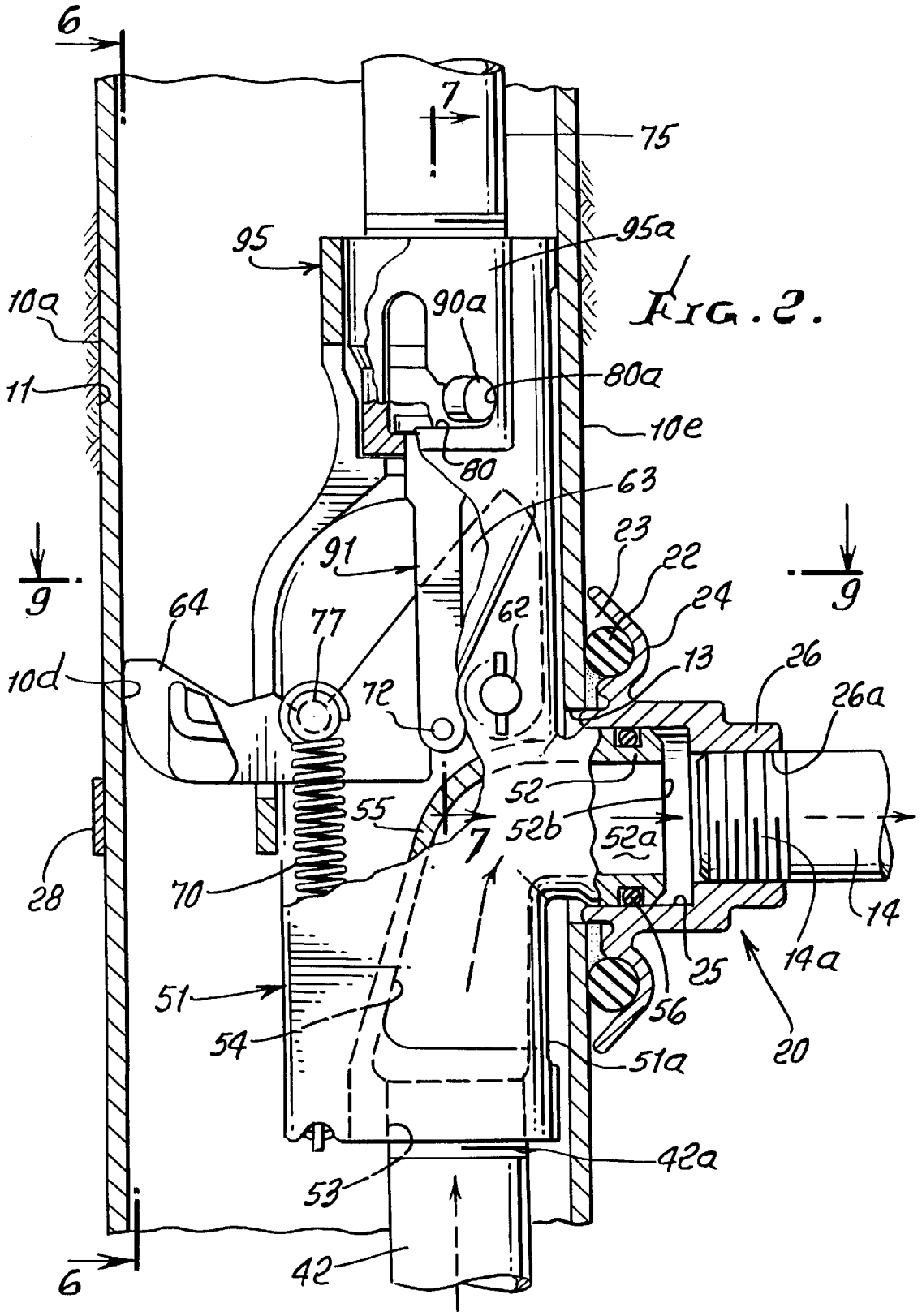
FIG. 2 is an enlarged section taken in elevation, showing details of the flow-diverting apparatus, in installed, flow diverting position.
Figure 9:
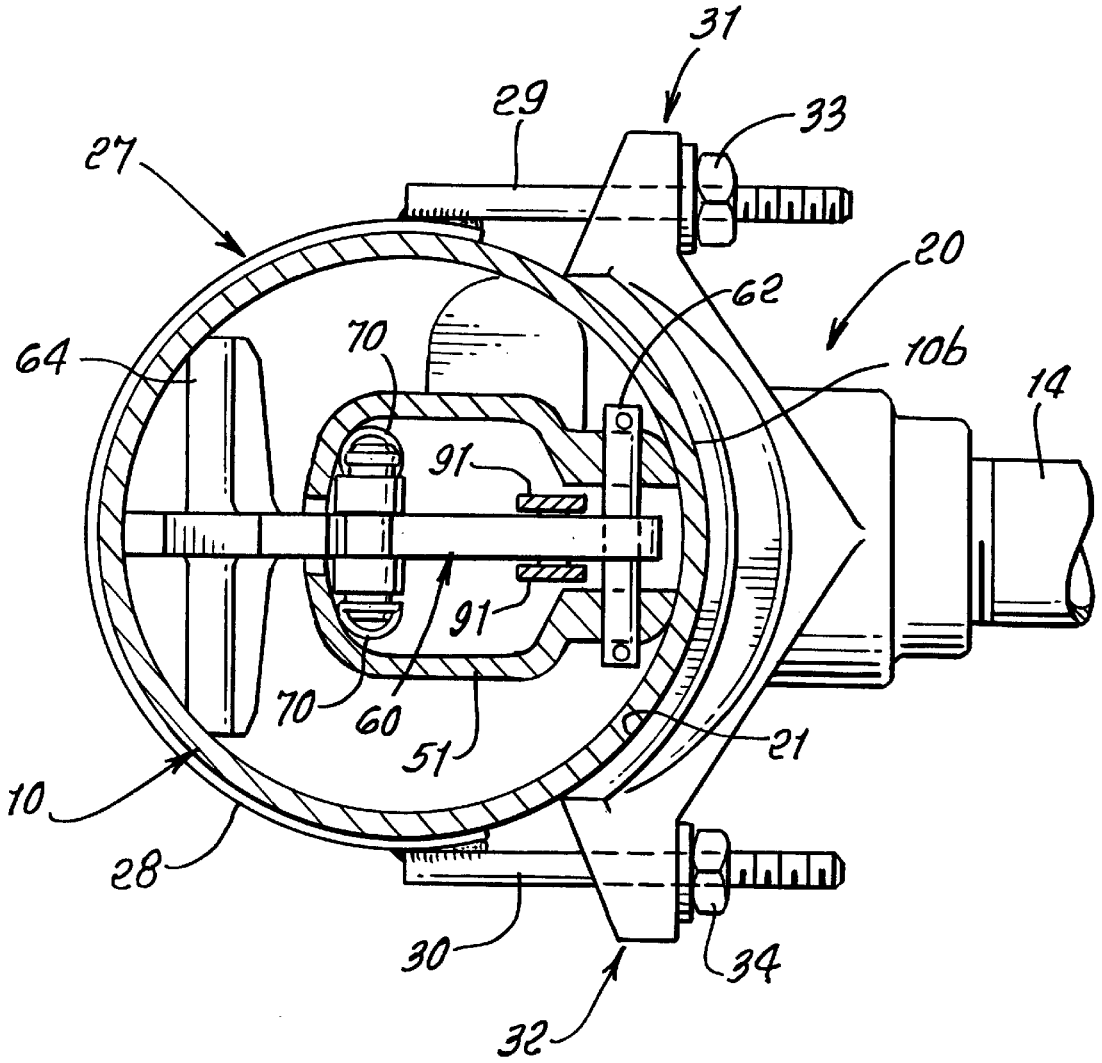
FIG. 9 is a horizontal section taken on lines 9—9 of FIG. 2.

A pipe fitting 20 is attached to the outer side of the casing in registration with the side port 13, to provide a transition to the pipe 14, and to seal off about the port. As seen in FIGS. 9 and 2, the fitting has a concave surface 21 that fits closely against the casing outer surface 10*b*, by and a generally annular elastomeric seal ring 22 in the form of a modified "O" is carried in the fitting groove 23 to be clamped against surface 10*e* and seal off about port 13. Groove 23 is formed by fitting wall 24. The fitting has a bore 25 in alignment with side port 13, and a tubular section 26 that is interiorly threaded at 26*a* to receive the threaded end 14*a* of pipe 14.

A U-shaped clamp 27 holds the fitting in position, and includes a strap 28 engaging the casing surface and fasteners 29 and 30 passing through fitting wings 31 and 32. Nuts 33 and 34 received on the fasteners are adjustably rotatable against the wings to adjustably clamp the strap 28 in position. See FIG. 9.

In accordance with the invention, it is desired to achieve diversion of water flow upwardly in the well to the lateral pipe 14, as by apparatus installable downwardly in the well from the surface, and also upwardly retrievable, when desired. Such retrieval may be desired as when a pump 40 is to be retrieved, for servicing.

FIG. 1 shows pump 40 installed in the well to receive water upward intake at 41, and to discharge water upwardly into a lower well pipe 42, via which water is to be delivered to lateral pipe 14. The pump may have an associated drive motor 43, and electrical lines to the motor are indicated at 44.

In particular, it is desired to achieve installation of flow-diversion apparatus 50 solely by manipulation of an upwardly extending support structure 75 associated with apparatus 50, forming an assembly.

Figure 3:
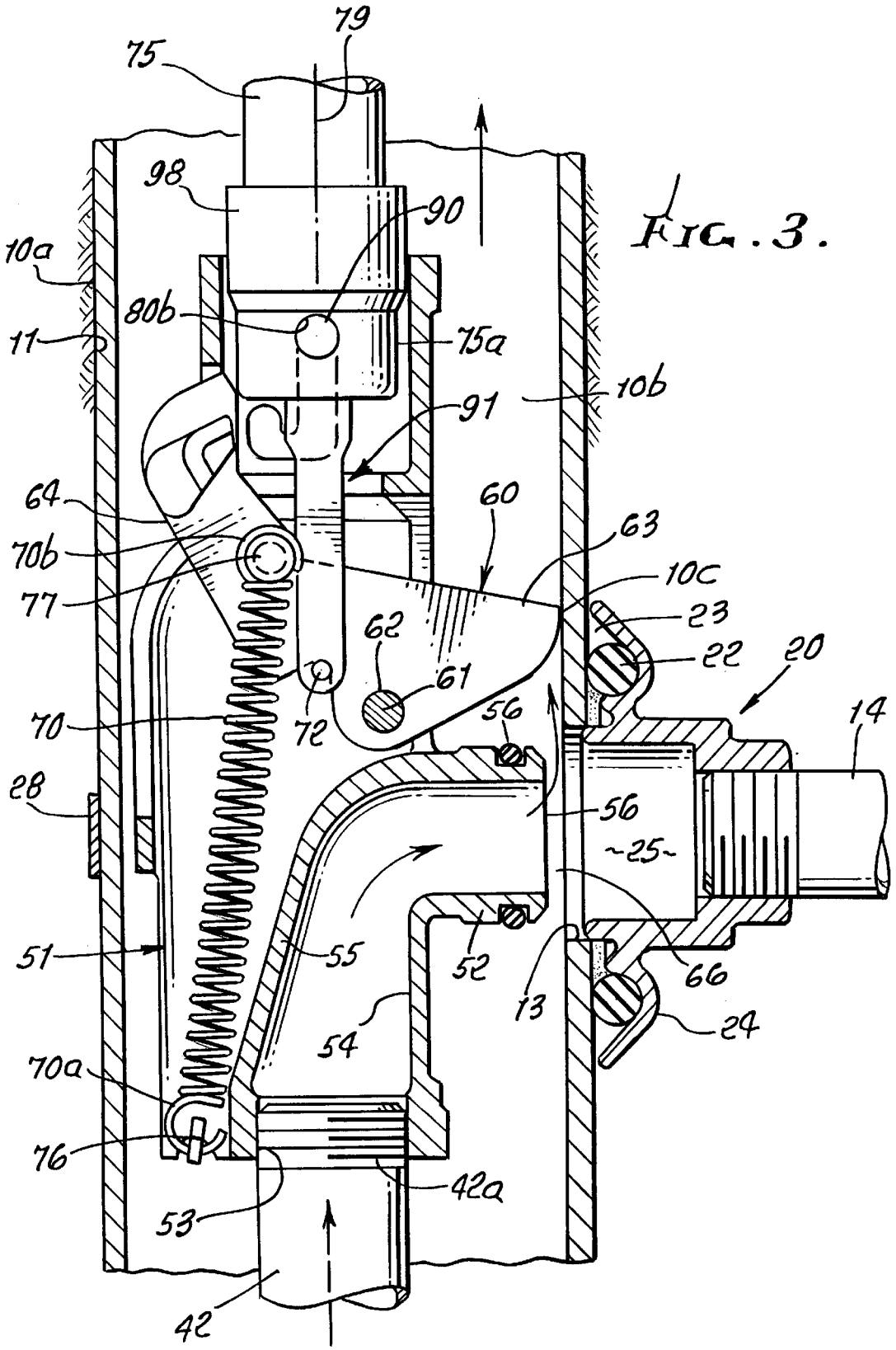
FIG. 3 is an enlarged section taken in elevation showing the flow-diverting apparatus in a travel mode, or configuration, enabling travel lengthwise in the well casing.
Figure 4:
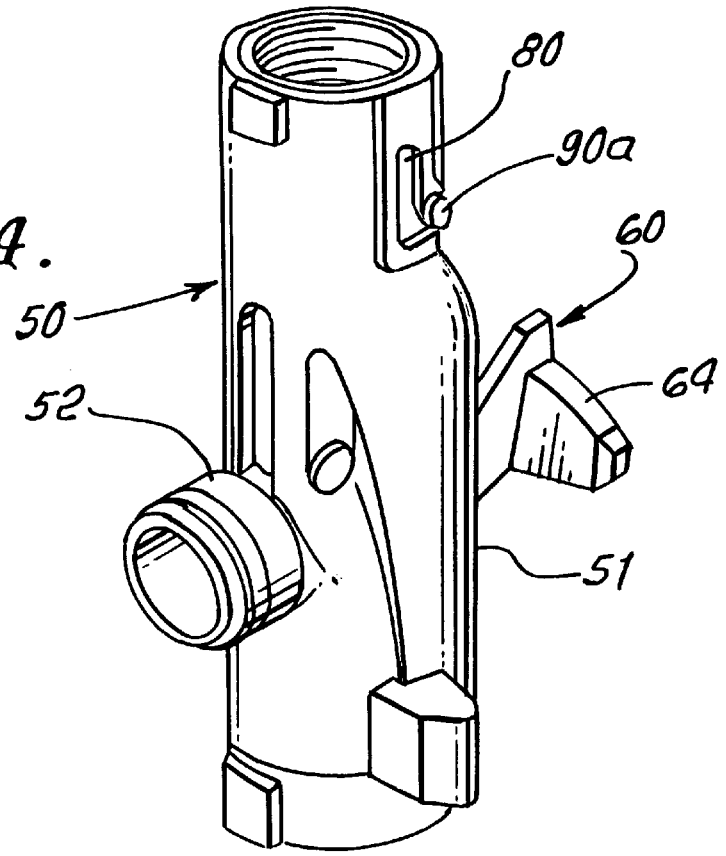
FIG. 4 is a perspective view of the flow-diverting apparatus.
Figure 5:
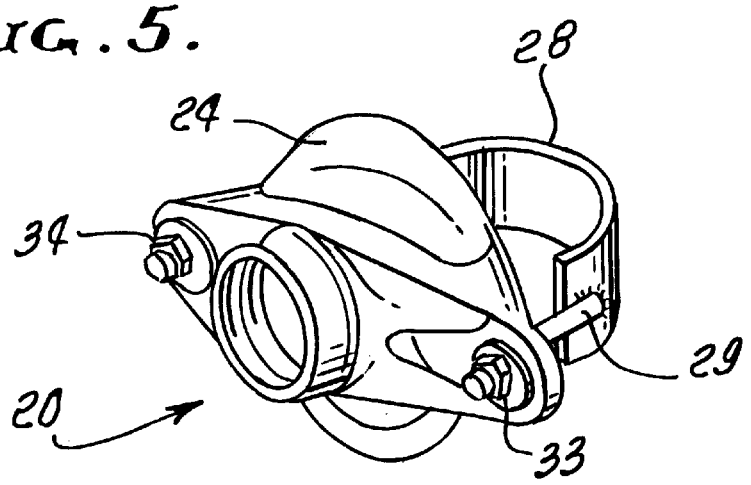
FIG. 5 is a perspective view showing sealing means applicable to the well casing to seal off a lateral flow nipple carried by the flow-diverting apparatus in installed position.
Figure 6:
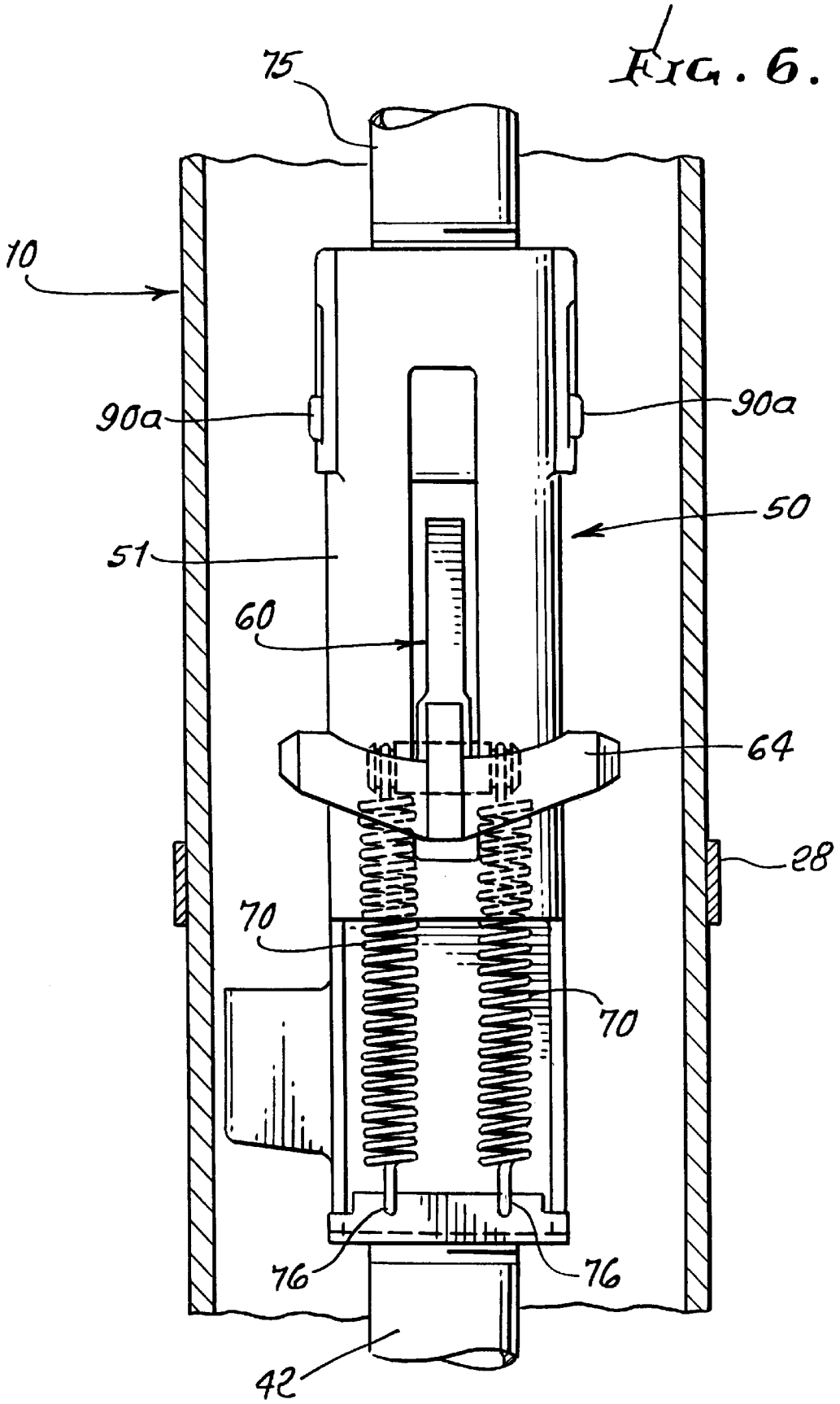
FIG. 6 is a section taken in elevation on lines 6—6 of FIG. 2.

The assembly includes a hollow body 51 sized to freely travel in the casing when lifted or lowered, in order to register a body side nipple 52 with the side port 13, for reception therein. Nipple 52 projects sidewardly of the body, as shown. Body 51 typically has a lower tubular connection, as for example threading at 53, to which the threaded upper end 42*a* of well pipe 42 is connectible, as seen in FIGS. 2 and 3.

Nipple interior 52*a* communicates with the lower tubular connection, as via a passage 54 in the hollow body 51. Passage 54 is formed by body side wall 51*a* and interior wall 55. When the body 51 is deflected laterally into the position seen in FIG. 2, the nipple passes through the side port 13, and into the fitting bore 25. An O-ring seal 56 on the nipple then seals against bore 25, as shown.

As referred to, dogging means is provided to be manipulatively engageable with a different portions of the well bore to selectively:

i) retain the nipple within the casing bore and out of the side port, as during upward travel of the hollow body in the casing (see FIG. 3), ii) urge the nipple laterally toward and into the side port, thereby to establish flow communication with a lateral underground flow line (see FIG. 2).

In the example shown, a dog 60 is pivotally connected to the hollow body 51, to pivot therein as about horizontal pivot axis 61. See also pivot pin 62. The dog has first and second legs 63 and 64 alternately engageable with the casing bore; see leg 63 engageable with the bore 10*b*, as at location 10*c* seen in FIG. 3, as during apparatus upward travel in the casing.

Leg 63 is in vertical alignment with the nipple, so that dogging, as shown in FIG. 3, acts to urge the hollow body and the nipple to the left sufficiently that the nipple also travels in the bore, with clearance at 66. This facilitates apparatus upward travel in the casing bore, as during retrieval.

During downward travel in the casing bore, as during installation, springs 70 urge the dog counterclockwise, as in FIG. 2, so that leg 64 engages the casing bore, as at 10*d*. This urges the hollow body and nipple to the right; and the nipple end 52*b* forcibly engages and scrapes against the casing bore. When the nipple 52 arrives in registration with the side port 13, it enters that port, and the right side of the hollow body engages the casing bore. See FIG. 2.

As seen in FIG. 1, a marker 67 on the support 75 at the surface may be azimuthally aligned with a marker 68 on the casing, to align the nipple with the side port 13 during installation.

It will be noted that the support structure 75, which may comprise a lifting and lowering rod, is the only manipulable means by which the hollow body is lowered and raised in the well, and which also achieves nipple insertion into the side port. Support rod 75 has two modes of manipulative attachment to the hollow body. In the mode seen in FIG. 3, a lower extension 75*a* of the support pivotally connected at 90 to a fork 91 is attached at 72 to the dog, to pull upwardly on the dog, rotating it clockwise to FIG. 3 position. The location of attachment 72 is leftward of the dog pivot axis 61.

At this time, springs 70 are stretched to the condition seen in FIG. 3. Note that the lower ends 70*a* of the springs are attached to the lower end of the hollow body at 76; and the upper ends 70*b* of the springs are attached to the dog at location 77, leftward of the pivots 62 and 72.

In the other mode of attachment of the support rod 75 to the hollow body, pin connection 90 on the support lower extension or portion 75*a* is rotated about the support axis 79 to bring pin ends 90*a* into recesses 80*a* of the J-slot 80, as seen in FIG. 2, as for example during lowering of the assembly in the well, as described. The J-slot is formed in the wall 95*a* of a receptacle 95 integral with the hollow body. Pin connection 90 is carried by a receptacle 98, which has thread connection at 95 to 75. Receptacle 98 moves with pin 90. The hand 91*c* at the top of the fork is rotatably mounted at 98*a* relative to the receptacle and pin.

Figure 7:
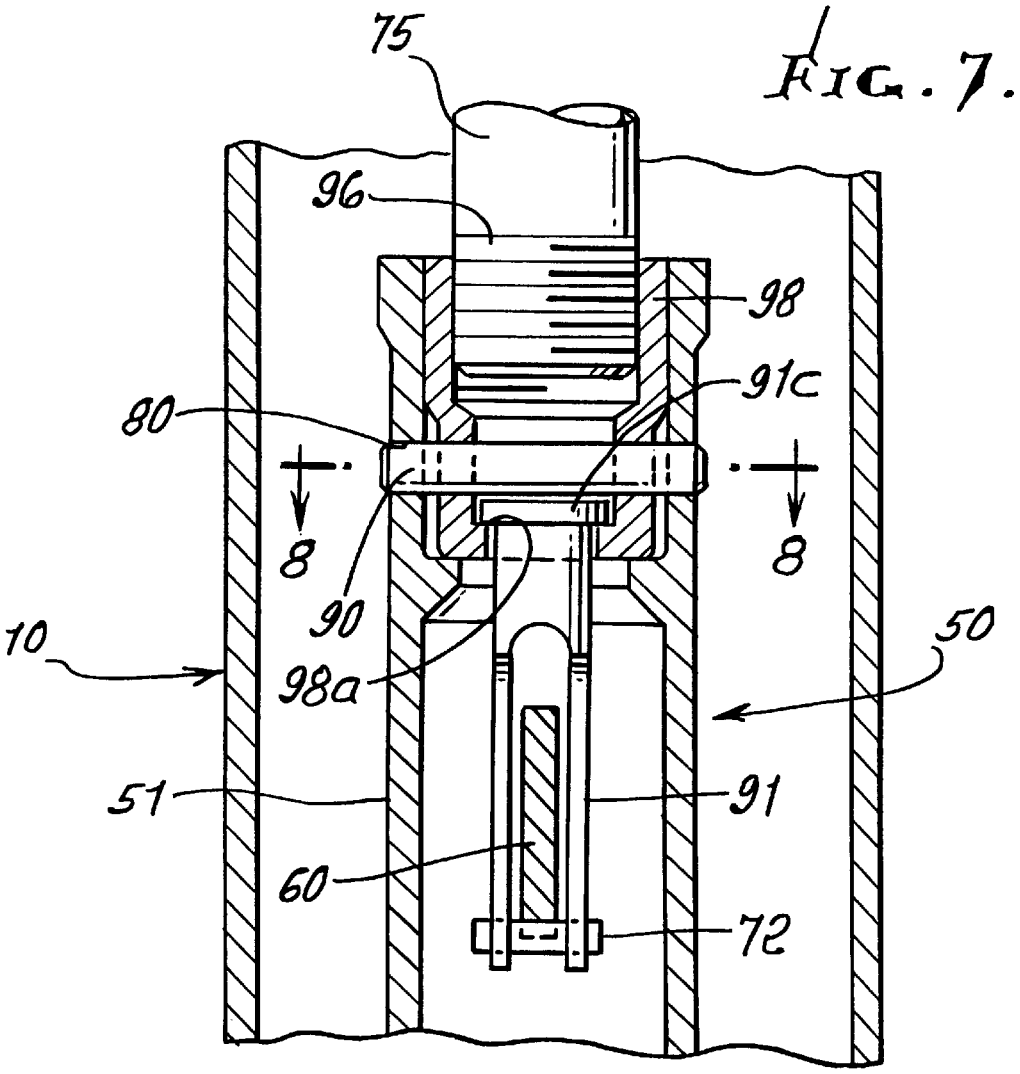
FIG. 7 is a section taken in elevation on lines 7—7 of FIG. 2.
Figure 8:
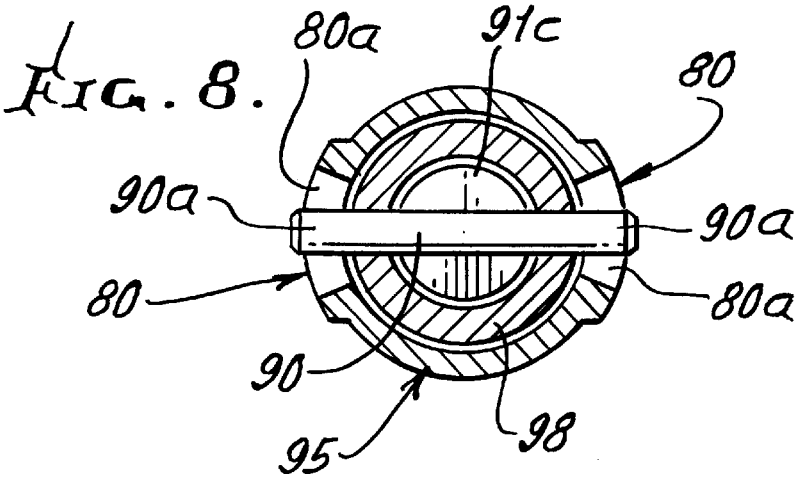
FIG. 8 is a horizontal section taken on lines 8—8 of FIG. 7.

Note that the connection 90 is now lowered relative to the dog pivot location, as is the spring attachment location 77. In FIG. 3, the pin 90 is at the uppermost shoulder 80*b* of the J-slot, Two J-slots 80 may be provided, as seen in FIGS. 7 and 8; and the pin 78 may extend endwise oppositely at two locations for reception into the two recesses 80*a* of the two J-slots.

Note that manipulation of the support rod 75 (axially and rotatably) achieves the two modes of connection, as described. Pin connection 90 and the J-slot or slots 80 may be considered as one form of tongue and groove connection elements.

I claim:

1. For combination with a tubular casing, the casing having a bore and a side wall through port, the improvement comprising an assembly to be lowered in the casing to establish water flow upwardly in the casing, and then out the side port, said assembly comprising in combination:

a) a hollow body sized to travel in the casing, the body having a side nipple, to be received in said port, the body having a lower connection to which a well pipe is connectible to deliver water upwardly to said nipple, b) a dog pivotally connected to the body and having first and second legs alternately engageable with the casing bore, c) and elongated support structure extending within and upwardly from said body and movable longitudinally in the casing and rotatable relative to the body, said structure having operative connection to said dog to pivot the dog between a first position in which the dog first leg engages the casing bore to thereby retain the nipple within the casing bore spaced from said side port, and a second position in which the dog first leg is retracted away from the casing bore and the dog second leg is engageable with the casing bore to urge the nipple sidewardly toward said side port.

2. The combination of claim 1 wherein said support structure supports said hollow body.

3. The combination of claim 2 wherein said support structure is movable relative to said hollow body between a primary position corresponding to said dog first position, and a secondary position corresponding to said dog second position.

4. The combination of claim 1 wherein said structure operative connection to the dog includes tongue and groove locking elements, one of said elements on said structure and the other of said elements on said hollow body, one of said elements rotatable relative to the other of said elements in response to rotation of said elongated support structure to interengage said tongue and groove elements, thereby locking said support structure in said secondary position.

5. The combination of claim 1 wherein said hollow body has a first axis extending generally vertically of the casing, and the dog has a pivot axis extending generally horizontally.

6. The combination of claim 1 wherein the support structure is connected to the hollow body via the dog.

7. The combination of claim 6 wherein the dog has a pivot axis, and said support structure is connected to the dog in offset relation to said dog pivot axis, to urge the dog clockwise upon upward displacement of the support structure.

8. The combination of claim 7 including a return spring in the hollow body urging the dog counterclockwise.

9. The combination of claim 1 wherein said support structure has first and second modes of attachment to the hollow body , said first mode of attachment being in effect when the dog first leg engages th e casing bore, and said second mod e of attachment being in effect when the dog second leg engages the casing bore.

10. The combination of claim 9 wherein said support structure in said first mode of attachment is upwardly displaced relative to said hollow body, and said support structure in said second mode of attachment is downwardly displaced relative to the hollow body and also rotated relative to the hollow body.

11. The combination of claim 10 wherein said hollow body has a wall defining a J-slot, there being a projection on said support structure that is received in said J-slot and movable between upper and lower positions therein corresponding to said first and second modes of attachment, respectively.

12. For combination with a tubular casing to be sunk in a well bore, the casing having a bore and a side wall through port, the improvement comprising an assembly to be lowered in the casing to establish water flow upwardly in the casing, and then out the side port, said assembly comprising:

a) a hollow body sized to travel in the casing, the body having a side nipple, to be received in said port, the body having a lower connection which a well pipe is connectible to deliver water upwardly to said nipple, b) and means, including dogging means manipulatively engageable with different portions of the well bore to selectively:

i) retain the nipple within the casing bore and out of the side port, as during travel of said hollow body in the casing, ii) urge the nipple laterally toward and into the side port, thereby to establish flow communication with a lateral underground flow line, iii) the dogging means rotatably supported about an axis extending lengthwise of the tubular body and relative to said body.

13. The combination of claim 1 wherein said casing extends substantially vertically in a well bore, said hollow body and dog located in the casing, for longitudinal travel therein.

14. The combination of claim 1 including a fork in said hollow body supporting the dog for pivoting about a first axis, the fork rotatably supported in the body for rotation with the dog about a second axis substantially at right angles to said first axis.

* * * * *